US008811564B2

(12) United States Patent
Chang et al.

(10) Patent No.: US 8,811,564 B2
(45) Date of Patent: Aug. 19, 2014

(54) LID FRAME FOR NUCLEAR FUEL ASSEMBLY SHIPPING CONTAINER AND SHIPPING CONTAINER FOR NUCLEAR FUEL ASSEMBLIES

(75) Inventors: Hung Soon Chang, Daejeon (KR); Chang Hwan Hwang, Daejeon (KR); Deuk Yeon Kim, Daejeon (KR); Jae Soon Choi, Daejeon (KR); Weon Chan Hwang, Daejeon (KR); Se Yong Shin, Chungcheongbuk-do (KR); Young Hoon Kim, Daejeon (KR)

(73) Assignee: Kepco Nuclear Fuel Co., Ltd., Daejeon (KR)

( * ) Notice: Subject to any disclaimer, the term of this patent is extended or adjusted under 35 U.S.C. 154(b) by 898 days.

(21) Appl. No.: 12/980,090

(22) Filed: Dec. 28, 2010

(65) Prior Publication Data

US 2012/0008730 A1 Jan. 12, 2012

(30) Foreign Application Priority Data

Jul. 12, 2010 (KR) ..... 10-2010-0066762

(51) Int. Cl.

| | |
|---|---|
| ***G21C 19/06*** | (2006.01) |
| ***G21F 5/008*** | (2006.01) |
| ***G21F 5/12*** | (2006.01) |
| *G21C 19/00* | (2006.01) |
| *G21F 5/00* | (2006.01) |

(52) U.S. Cl.

USPC ..... 376/272; 376/260; 220/200; 220/315; 220/324; 250/505.1; 250/506.1

(58) Field of Classification Search

USPC ..... 376/260, 272, 463; 34/523, 60; 198/463.1, 469.1, 470.1, 474.1, 476.1; 206/701, 706, 707; 248/127, 128, 133, 248/139, 141, 200, 205.1, 226.11, 231.71, 248/231.81, 231.85, 317, 323, 327; 220/4.01, 4.28, 4.33, 200, 315, 319, 220/320, 321, 324, 327, 328, 485; 250/505.1–519.1

See application file for complete search history.

(56) References Cited

U.S. PATENT DOCUMENTS

| | | | | | |
|---|---|---|---|---|---|
| 3,734,439 | A | * | 5/1973 | Wintz | 220/485 |
| 3,888,379 | A | * | 6/1975 | Folberth | 220/4.28 |
| 4,317,551 | A | * | 3/1982 | Bishop | 248/141 |
| 4,418,820 | A | * | 12/1983 | Nagle et al. | 206/707 |
| 4,478,331 | A | * | 10/1984 | Ruin | 206/707 |
| 4,637,763 | A | * | 1/1987 | Van Iperen | 248/327 |
| 5,190,257 | A | * | 3/1993 | Gradei et al. | 248/231.71 |
| 5,263,063 | A | * | 11/1993 | Sappey | 376/272 |
| 5,263,064 | A | * | 11/1993 | Sappey | 376/272 |
| 5,481,117 | A | * | 1/1996 | Gilmore et al. | 376/272 |

(Continued)

*Primary Examiner* — Bernarr Gregory

(74) *Attorney, Agent, or Firm* — Rabin & Berdo, P.C.

(57) ABSTRACT

A lid frame for a nuclear fuel assembly shipping container and a shipping container for nuclear fuel assemblies are provided. The shipping container includes a lower container having a cradle, an upper container detachably coupled to the lower container, and a base frame coupled to the cradle with at least one nuclear fuel assembly placed thereon. The lid frame includes a plurality of supports installed apart from each other so as to surround the nuclear fuel assembly placed on the base frame, a plurality of clamps separated from each other, coupled to the supports so as to be perpendicular to the supports, rotatably hinged to the base frame, and clamping the nuclear fuel assembly, and a plurality of gap compensators coupled to inner surfaces of the supports in order to compensate for a gap between the inner surfaces of the supports and the nuclear fuel assembly.

13 Claims, 4 Drawing Sheets

(56) References Cited

U.S. PATENT DOCUMENTS

| | | | | |
|---|---|---|---|---|
| 5,515,405 | A * | 5/1996 | Gilmore et al. | 376/272 |
| 5,542,576 | A * | 8/1996 | Arment | 220/328 |
| 5,600,896 | A * | 2/1997 | Lin | 34/60 |
| 5,607,045 | A * | 3/1997 | Kronseder | 198/476.1 |
| 5,617,967 | A * | 4/1997 | Neidhart | 220/4.33 |
| 5,743,377 | A * | 4/1998 | Kronseder | 198/470.1 |
| 5,762,227 | A * | 6/1998 | Mitchell | 220/321 |
| 6,581,264 | B2 * | 6/2003 | Ohori et al. | 220/324 |
| 6,748,042 | B1 * | 6/2004 | Stilwell et al. | 376/272 |
| 6,898,258 | B2 * | 5/2005 | Ohsono et al. | 376/272 |
| 7,327,821 | B2 * | 2/2008 | Ishihara et al. | 376/272 |
| 8,135,107 | B2 * | 3/2012 | Singh et al. | 376/272 |
| 2009/0190711 | A1 * | 7/2009 | Fantini | 376/272 |

* cited by examiner

LID FRAME FOR NUCLEAR FUEL ASSEMBLY SHIPPING CONTAINER AND SHIPPING CONTAINER FOR NUCLEAR FUEL ASSEMBLIES

CROSS-REFERENCE TO RELATED APPLICATIONS

The present application claims priority under 35 U.S.C. 119 to Korean Patent Application No. 10-2010-0066762, filed on Jul. 12, 2010, the disclosure of which is expressly incorporated by reference herein in its entirety.

BACKGROUND OF THE INVENTION

1. Field of the Invention

The present invention relates, in general, to a shipping container for safely transporting a nuclear fuel assembly to a nuclear power plant, etc. after the nuclear fuel assembly has been produced and, more particularly, to a lid frame for a nuclear fuel assembly shipping container, which is equipped with gap compensators adapted to minimize a gap between a nuclear fuel assembly and a lid frame for clamping the nuclear fuel assembly in a shipping container, and a shipping container for nuclear fuel assemblies.

2. Description of the Related Art

In general, nuclear fuels such as enriched uranium or mixed oxide need to be transported between various places, for instance a place where they are concentrated, a fuel rod producing place, and so on. For this transporting stage, the fuels are typically shaped like a small pellet.

These fuels require a constant level of thermal insulation and structural strength to comply with international standards, and the control of their criticality is a main concern, and a mass of enriched fuel in a shipping container should be strictly restricted such that no dangerous situations occur. Due to this requirement, the volume of fuel that can be transported in a shipping container of a certain volume is strictly restricted.

As a result, numerous shipping containers for transporting the nuclear fuel assembly have been disclosed. These shipping containers are generally designed so that a pair of lid frames are coupled to opposite long sides of the shipping container with the nuclear fuel assembly disposed therebetween so that the nuclear fuel assembly is clamped. The strength of the shipping container itself including the lid frames must be reliable, and thus the containers are typically formed of a metal material.

Meanwhile, the nuclear fuel assemblies produced at present are not limited to one type but are classified into a variety of types. As such, they are different in size from each other. In contrast, the lid frames applied to the shipping container are designed to clamp one specific type of nuclear fuel assembly. Thus, to transport all types of nuclear fuel assemblies, the lid frames should be provided so as to correspond to these types. For this reason, the manufactured lid frames are not cost-effective, and it takes much manpower and time to replace the lid frames so that they are suited to the nuclear fuel assemblies. Furthermore, a storage space for storing the manufactured lid frames is needed.

In addition, in the case of conventional nuclear fuel assembly shipping containers with clamps having the same size, since positions of spacer grids are different depending on the type of nuclear fuel assembly, the lid frames on which the clamps are disposed so as to correspond to the positions of the spacer grids should be used to transport different types of nuclear fuel assemblies. Accordingly, the lid frames should be provided depending on the type of nuclear fuel assembly.

SUMMARY OF THE INVENTION

Accordingly, the present invention has been made keeping in mind the above problems occurring in the related art, and embodiments of the present invention provide a lid frame for a nuclear fuel assembly shipping container which is equipped with gap compensators, and a shipping container for nuclear fuel assemblies, which allow various types of nuclear fuel assemblies to be clamped with one type of lid frame, and which allows various types of nuclear fuel assemblies to be transported by one type of shipping container.

Embodiments of the present invention also provide a lid frame for a nuclear fuel assembly shipping container which is equipped with gap compensators, and a shipping container for nuclear fuel assemblies, which allow various types of nuclear fuel assemblies whose spacer grids are located at different positions to be transported using one type of lid frame.

According to an aspect of the present invention, there is provided a lid frame for a nuclear fuel assembly shipping container, in which the shipping container includes a lower container in which a cradle is installed, an upper container detachably coupled to the lower container, and a base frame coupled to the cradle with at least one nuclear fuel assembly placed thereon. The lid frame can include: a plurality of supports installed apart from each other so as to surround the nuclear fuel assembly placed on the base frame; a plurality of clamps separated from each other, coupled to the supports so as to be perpendicular to the supports, rotatably hinged to the base frame, and configured to clamp the nuclear fuel assembly; and a plurality of gap compensators coupled to inner surfaces of the supports in order to compensate for a gap between the inner surfaces of the supports and the nuclear fuel assembly.

According to another aspect of the present invention, there is provided a shipping container for nuclear fuel assemblies. The shipping container can include: a lower container in which a cradle is installed; an upper container detachably coupled to the lower container; a base frame coupled to the cradle with at least one nuclear fuel assembly placed thereon; and a pair of lid frames installed on opposite long sides of the base frame in order to clamp the nuclear fuel assembly placed on the base frame. Further, each lid frame can include: a plurality of supports installed apart from each other so as to surround the nuclear fuel assembly placed on the base frame; a plurality of clamps separated from each other, coupled to the supports so as to be perpendicular to the supports, rotatably hinged to the base frame, and configured to clamp the nuclear fuel assembly; and a plurality of gap compensators coupled to inner surfaces of the supports in order to compensate for a gap between the inner surfaces of the supports and the nuclear fuel assembly.

Here, each gap compensator can have an "L" shape formed by an upper plate and a lateral plate so as to correspond to a shape of the lid frame.

Further, each support can include support holes formed in an upper and lateral surfaces thereof; each gap compensator can include screw holes formed in the upper and lateral plates thereof; and the support holes can be aligned with the screw holes.

Also, each gap compensator can be installed between the clamps coupled to the lid frame.

The lid frame can further include press members coupled to press plate holding recesses formed in inner surfaces of the plurality of clamps including narrow clamps and wide clamps in order to press spacer grids of the nuclear fuel assembly.

In addition, each press member can include: a press plate that is interposed between each clamp and each spacer grid; and adjustment screws, each of which passes through each clamp to be coupled to the press plate.

According to another aspect of the present invention, the lid frame is installed in the shipping container to stably clamp the nuclear fuel assembly, and forms a lattice shape, so that it is possible to safely protect the nuclear fuel assembly compared to an existing method of clamping the nuclear fuel assembly only with clamps. Further, the gap compensators are installed to compensate for a gap between the lid frame and the nuclear fuel assembly, so that it is possible to compensate for the gap between the lid frame and the nuclear fuel assembly having a small size, and thus it is possible to prevent expansion of the nuclear fuel assembly when an accident takes place when the nuclear fuel assembly is being transported. Further, it is possible to transport various types of nuclear fuel assemblies using one type of shipping container without replacing the lid frame.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Reference will now be made in greater detail to exemplary embodiments of the invention with reference to the accompanying drawings.

Figure 1:
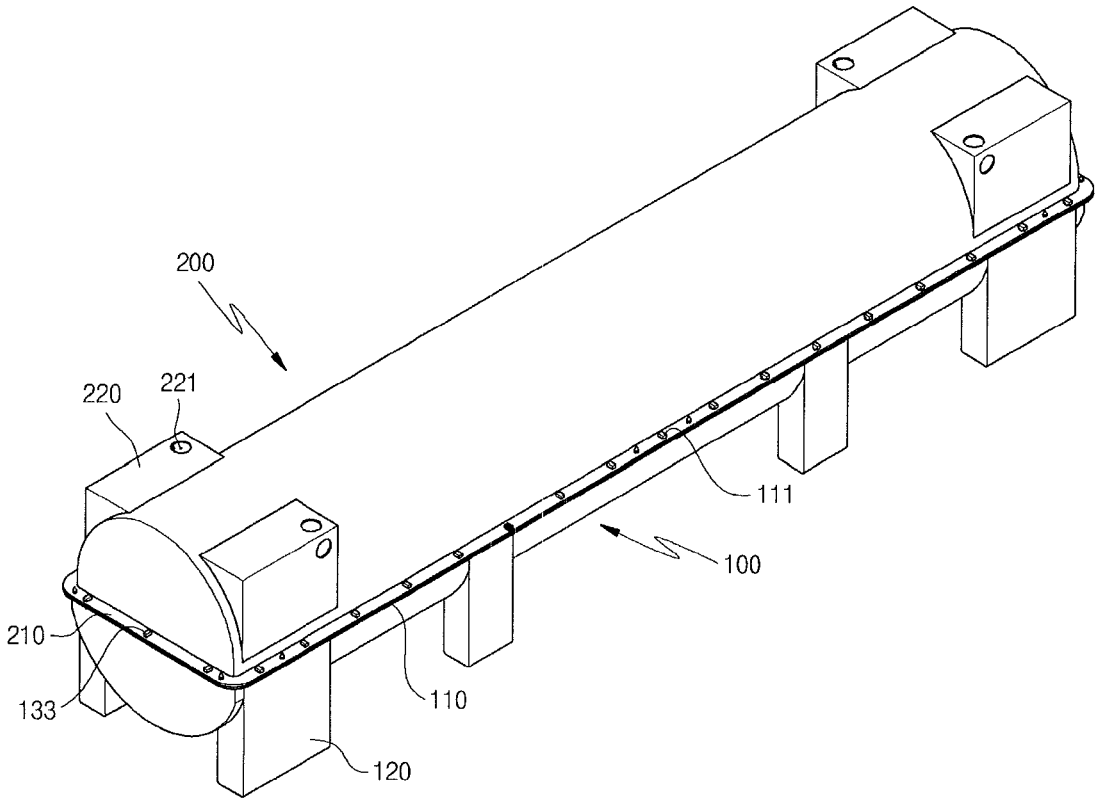
FIG. 1 shows an appearance of a nuclear fuel assembly shipping container according to an exemplary embodiment of the present invention.

FIG. 1 shows an appearance of a nuclear fuel assembly shipping container according to an exemplary embodiment of the present invention. The shipping container of this embodiment is configured so that a cross section of a lower container 100 and an upper container 200 is semi-circular such that at least one nuclear fuel assembly 10 can be held, and the lower container 100 and the upper container 200 are coupled so as to be opposite to each other. Here, each of the lower and upper containers 100 and 200 can be formed of a metal material strong enough to safely transport the nuclear fuel assembly 10.

In detail, the shipping container of this embodiment is configured so that the upper container 200 is detachably coupled to the lower container 100, the lower and upper containers 100 and 200 are provided with flanges 110 and 210 on outer circumferences thereof, the flange of the lower container 100 has a plurality of assembly protrusions 111 protruding therefrom at regular intervals, and the flange of the upper container 200 is provided with a plurality of assembly holes 211 (see FIG. 2) so as to correspond to and be engaged with the protrusions 111.

Further, the lower container 100 has a plurality of support legs 120 installed on an outer surface thereof at predetermined intervals so as to support the shipping container. The upper container 200 is provided with loading parts 220 on opposite long sides thereof. Each load part 220 is provided with lift holes 221 such that the upper container 200 can be lifted by, for instance, a crane.

Figure 2:
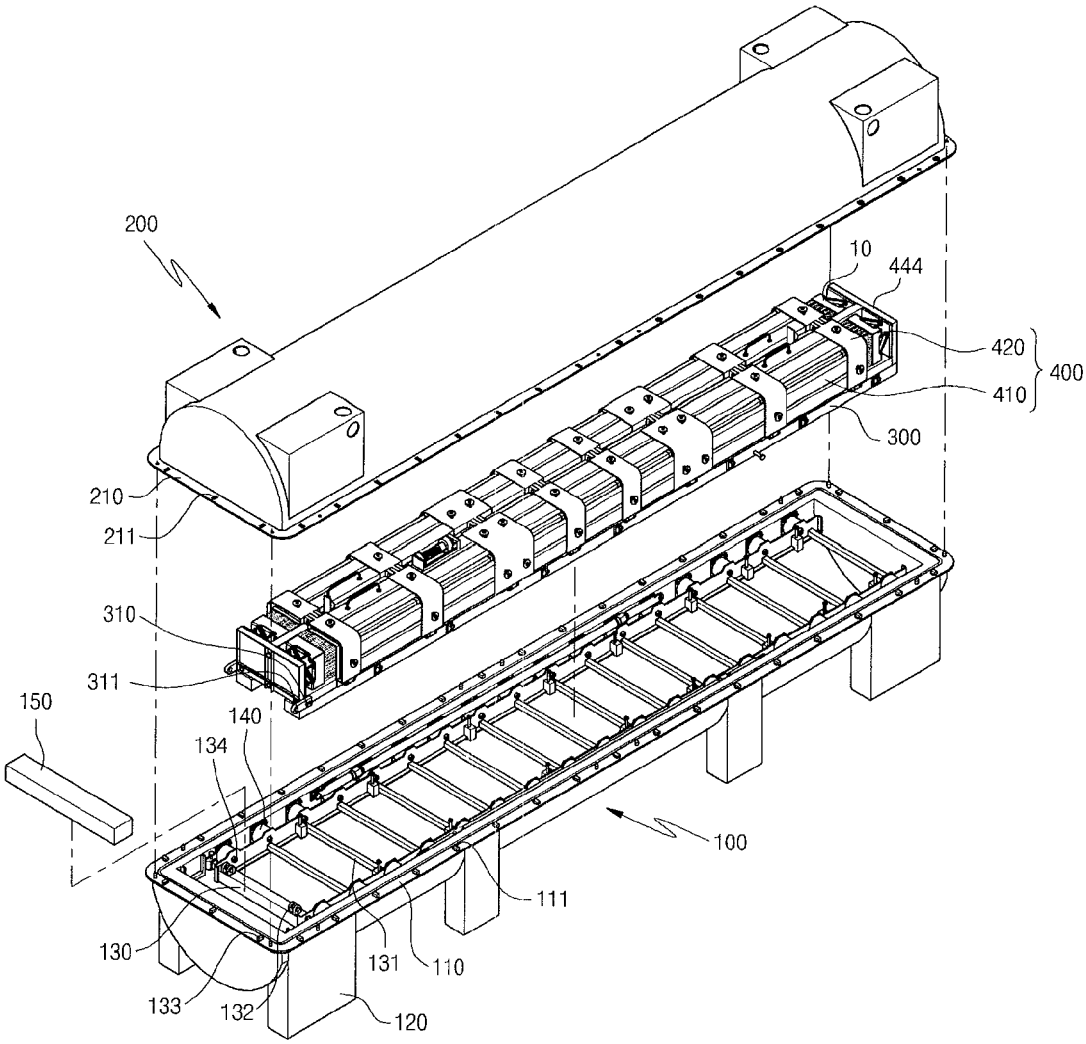
FIG. 2 is an exploded perspective view showing a nuclear fuel assembly shipping container according to an exemplary embodiment of the present invention.
Figure 3:
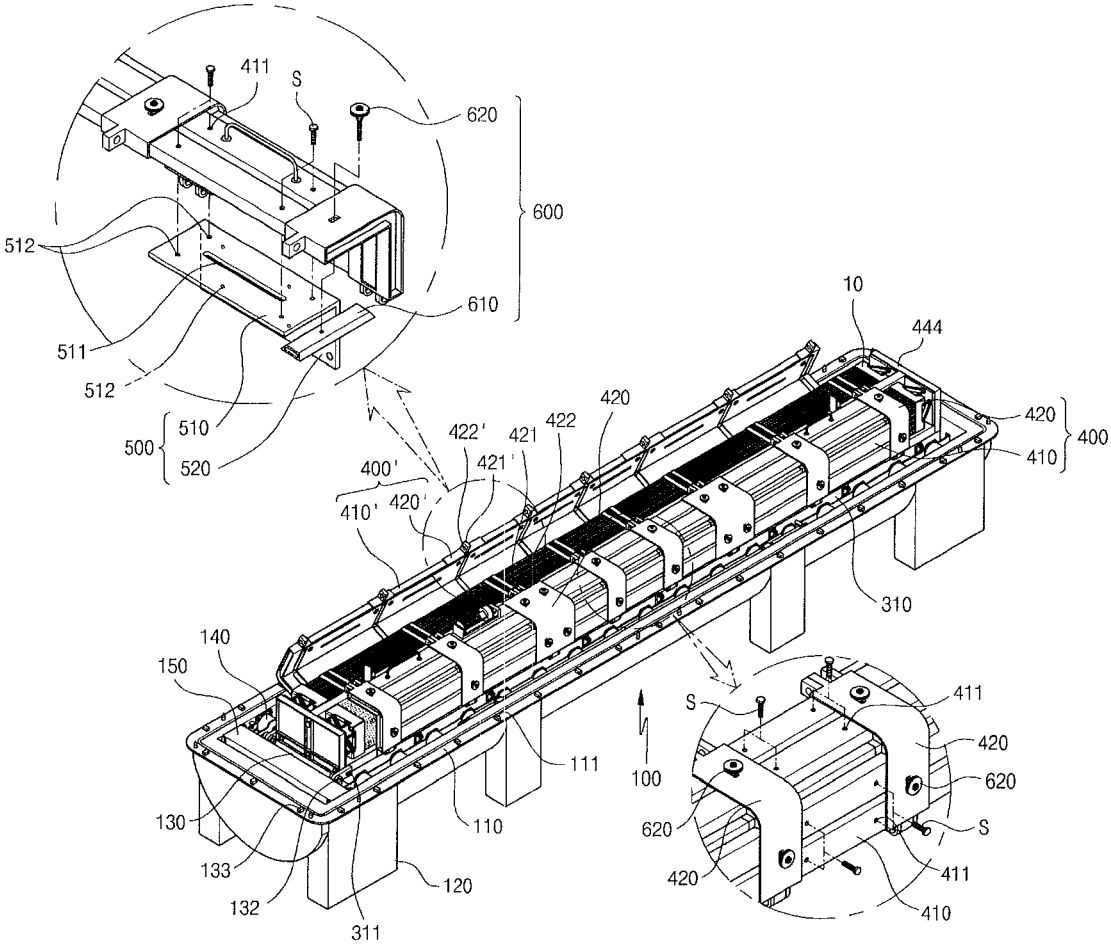
FIG. 3 is a perspective view showing a nuclear fuel assembly shipping container according to an exemplary embodiment of the present invention, wherein an upper container is removed from the nuclear fuel assembly shipping container.
Figure 4:
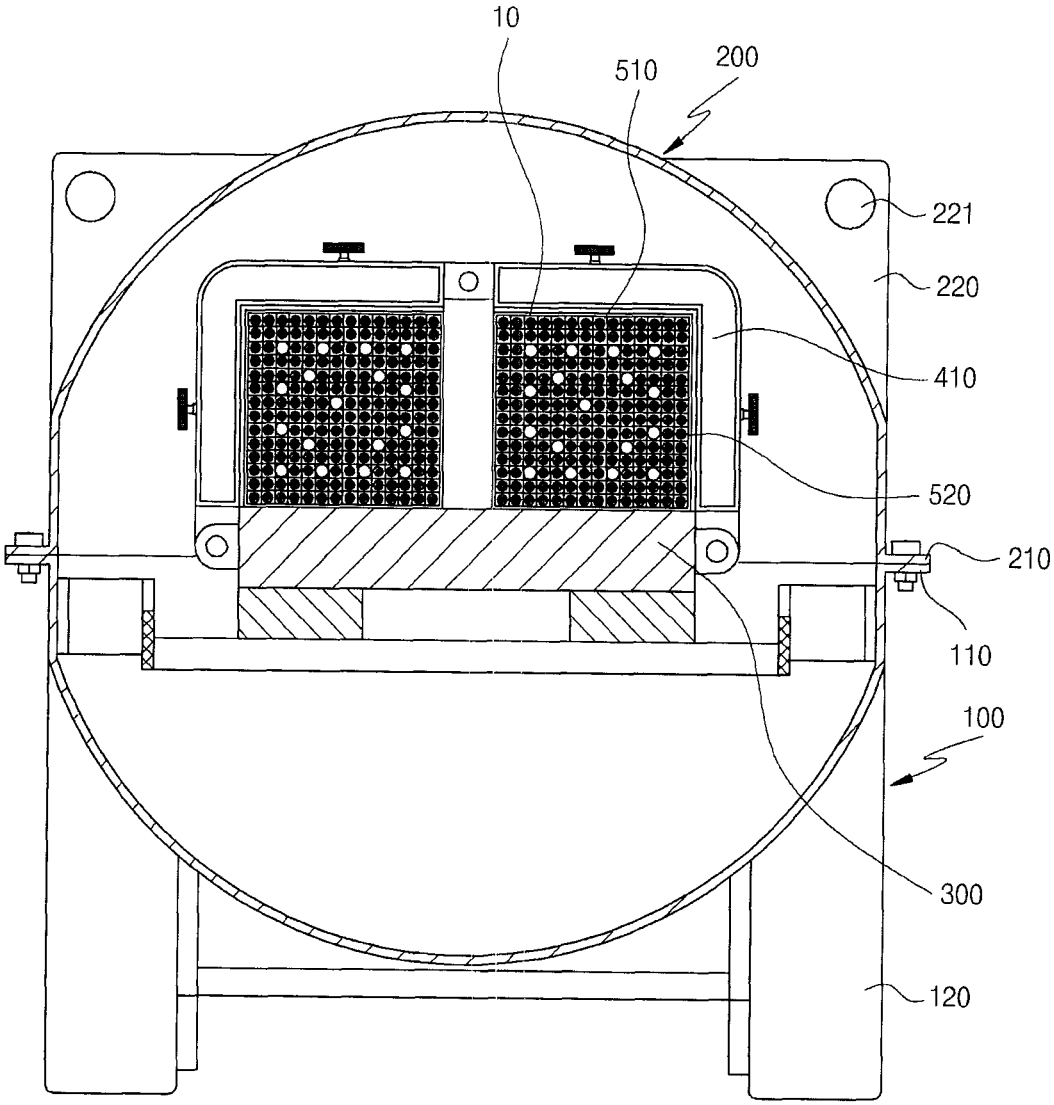
FIG. 4 is a cross-sectional view showing a nuclear fuel assembly shipping container according to an exemplary embodiment of the present invention.

FIGS. 2 and 3 are exploded perspective views showing a nuclear fuel assembly shipping container according to an exemplary embodiment of the present invention, wherein the lower and upper containers 100 and 200 are separated from each other. FIG. 4 is a cross-sectional view showing a nuclear fuel assembly shipping container according to an exemplary embodiment of the present invention, wherein gap compensators 500 are installed between a lid frame 400 or 400' and a nuclear fuel assembly 10.

The lower container 100 is provided therein with a base frame 300 and a pair of lid frames 400 and 400' so as to be able to stably support the nuclear fuel assembly 10. A cradle 130 is installed in the lower container 100 such that the base frame 300 can be placed on the cradle 130. The base frame 300 is placed on the cradle 130 with the nuclear fuel assembly 10 supported on an upper surface thereof. The cradle 130 has a plurality of supports 131 installed in a lengthwise direction at predetermined intervals. The cradle 130 is fixed to the lower container 100 by fasteners 134 such as screws. Here, buffers 140 formed of a rubber material are interposed between the lower container 100 and the cradle 130 in order to relieve external shocks that can be applied to the nuclear fuel assembly 10. Each buffer 140 is provided with a fastener hole (not shown) in the center thereof in a lengthwise direction. The fasteners 134 are fastened into the fastener holes through the cradle 130. Thereby, the cradle 130 is fixedly coupled to the lower container 100 so as to be able to absorb shocks.

The lid frame 400 or 410' includes supports 410 or 410' stably surrounding the nuclear fuel assembly 10, narrow clamps 420 or 420' and wide clamps **420*a* or 420*a*' disposed on the supports 410 or 410' at predetermined intervals, and end support plates 444 supporting opposite ends of the nuclear fuel assembly 10. The supports 410 or 410' are separated from each other, and are installed in a lengthwise direction of the nuclear fuel assembly 10. Here, the supports 410 or 410' are each provided with support holes 411 in upper and lateral surfaces thereof so as to correspond to screw holes 512 of each gap compensator 500**, which will be described below.

Each of the narrow clamps 420 or 420' and the wide clamps **420*a* or 420*a*' is hinged to the base frame 300 at one end thereof; so as to open outwardly when rotated along with the supports. Here, the narrow clamps 420 or 420' and the wide clamps 420*a* or 420*a*' are welded to the supports 410 or 410', which are separated from each other, so as to be perpendicular to the supports 410 or 410', and thus are integrally formed with the supports 410 or 410' so as to be able to be rotated about the nuclear fuel assembly 10**.

Meanwhile, in this embodiment, the shipping container for transporting two nuclear fuel assemblies 10 at the same time has been described by way of example. The lid frames 400 and 400' are installed on the base frame 300 on opposite long sides of a width direction of the base frame 300 so as to be rotatably opposite to each other. Further, each pair of narrow clamps 420 and 420' or each pair of wide clamps **420*a* and 420*a*' is configured to be fastened to each other, and is provided with male and female fasteners 421 and 421'** on free ends thereof so as to be engaged with each other, respectively.

Further, the male and female fasteners 421 and 421' are provided with bolting holes 422 and 422' respectively, so that they can be firmly fixed to each other by a fixing bolt (not shown). Here, the narrow clamps 420 or 420' are arranged so as to correspond to the spacer grids of the nuclear fuel assembly 10, so that they can stably clamp the nuclear fuel assembly 10.

In this manner, the lid frame 400 or 400' of this embodiment is configured so that the supports 410 or 410', which are separated from each other, and the narrow clamps 420 or 420' and the wide clamps 420*a* or 420*a*', which are coupled to the supports 410 or 410' at predetermined intervals respectively, have a lattice shape. Thus, the lid frames 400 and 400' can be remarkably reduced in weight compared to a conventional lid frame where a pair of clamping frames is formed in a completely closed shape, and thus making transportation easier. Furthermore, the lid frames 400 and 400' can also reduce the cost of production, which is advantageous from the economical point of view.

Here, in the lid frames 400 and 400', the narrow clamps 420 and 420' and the wide clamps 420*a* and 420*a*' are rotatably coupled so as to be able to surround the nuclear fuel assemblies 10 placed on the base frame 300, are symmetrically disposed on the supports 410 and 410', which are separated from each other, at predetermined intervals in a lengthwise direction so as to be perpendicular to the supports 410 and 410', and to clamp the respective nuclear fuel assemblies 10.

Meanwhile, since the nuclear fuel assemblies 10 produced at present are not limited to one type but are classified into a variety of types, they are different in size from each other. Thus, to clamp each type of nuclear fuel assemblies 10 in the shipping container, the lid frames 400 and 400' manufactured so as to suit each type of nuclear fuel assembly 10 are required. In this case, the manufactured lid frames 400 and 400' are not cost-effective, and it takes a lot of manpower and time to replace the lid frames 400 and 400' so as to suit them to the type of nuclear fuel assembly. Furthermore, a storage space for storing the manufactured lid frames 400 and 400' is needed according to the type.

For this reason, in the present invention, the gap compensators 500 are interposed between the lid frame 400 or 400' and the nuclear fuel assembly 10 so as to be able to clamp various types of nuclear fuel assemblies 10 using one type of lid frames 400 or 400' regardless of the type of nuclear fuel assembly 10.

Each gap compensator 500 is bent in an "L" shape to form an upper plate 510 and a lateral plate 520 so as to correspond to the shape of the lid frame 400 or 400', and is formed of aluminum so as to be able to minimize its weight while ensuring sufficient stiffness in the event of the gap compensation. The upper plate 510 is provided with screw holes 512, and thus is fixed to the lid frame 400 or 400' by fixing screws S. Additionally, to further reduce the weight of the shipping container, the upper plate 510 of the gap compensator 500 can be provided with guide slots 511 in a lengthwise direction so as to correspond to the spacing between the supports 410 or 410'.

Each gap compensator 500 constructed as described above is fixed with the fixing screws S so as to align the support holes 411, which are formed in the upper and lateral surfaces of the supports 410 or 410'included in the lid frame 400 or 400', with the screw holes 512, which are formed in an upper plate and a lateral plate 510 and 520 of each gap compensator 500.

The gap compensators 500 are installed between the narrow clamps 420 or 420' and the wide clamps 420*a* or 420*a*', both of which are coupled to the lid frame 400 or 400'. The narrow clamps 420 or 420' and the wide clamps 420*a* or 420*a*' are provided with press plate holding recesses 630 or 630' formed in inner surfaces thereof at a predetermined depth in order to receive a press plate 610 configured to press the spacer grids of the nuclear fuel assembly 10. Thus, the nuclear fuel assembly 10 can be more stably clamped by press members 600 installed in the press plate holding recesses 630 or 630'.

Each press member 600 includes the press plate 610, which is interposed between each of the clamps 420, 420', 420*a* and 420*a*' and each spacer grid, and extends in a lengthwise direction of the clamp in an approximately flat plate shape, and adjustment screws 620, each of which passes through each of the clamps 420, 420', 420*a* and 420*a*' to be coupled to the press plate 610. Thus, the press plate 610 is pressed or unpressed using the adjustment screws 620, so that the nuclear fuel assembly 10 can be firmly clamped to the lid frame 400 or 400'.

Meanwhile, the press plate holding recesses 630 or 630', each of which holds the flat-plate-shaped press plate 610, are formed inside each of the narrow clamps 420 or 420' and the wide clamps 420*a* or 420*a*'. Here, a plurality of press plate holding recesses 630 or 630', each of which holds the flat-plate-shaped press plate 610, is formed inside each of the wide clamps 420*a* or 420*a*', and the flat-plate-shaped press plates 610 have the same dimensions as the press plate holding recesses 630 or 630' formed inside each of the wide clamps 420*a* or 420*a*' so as to be compatible with dimensions (width and length) of each of the wide clamps 420*a* or 420*a'*.

These wide clamps 420*a* or 420*a*' are formed so as to have a width that covers a change in position of each spacer grid of the nuclear fuel assembly to be transported. Thereby, in different types of nuclear fuel assemblies between which the position of each spacer grid is different, the spacer grid located at a different position can be fixedly pressed using the press plate 610. Accordingly, the lid frame 400 or 400' can clamp and transport the different types of nuclear fuel assemblies without requiring a separate change in structure.

In the state where the nuclear fuel assemblies 10 are stably clamped by the gap compensators 500 and the press members 600 of the lid frames 400 and 400', when the nuclear fuel assemblies 10 are transported to a nuclear power plant, they can be transported without external shocks subjecting them to vibrations in the shipping container. Thereby, it is possible to prevent the nuclear fuel assemblies 10 from being damaged.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A lid frame of a shipping container for nuclear fuel assembly, the lid frame comprising:

a plurality of clamps separated from each other and rotatably hinged to a base frame;

a plurality of supports installed apart from each other and coupled perpendicularly to the plurality of clamps; and a plurality of gap compensators coupled to inner surfaces of the supports and configured to compensate for a gap around the inner surfaces of the supports.

2. The lid frame according to claim 1, wherein each gap compensator of the plurality of gap compensators includes an upper plate and a lateral plate forming an "L" shape corresponding to a shape of the lid frame.

3. The lid frame according to claim 2, wherein each of the gap compensators is installed between the plurality of clamps coupled to the lid frame.

4. The lid frame according to claim 1, wherein each of the supports includes support holes, each of the gap compensators includes screw holes in the upper and lateral plates thereof, and the support holes are aligned with the screw holes.

5. The lid frame according to claim 4, wherein each of the gap compensators is installed between the plurality of clamps coupled to the lid frame.

6. The lid frame according to claim 4, further comprising press members coupled to press plate holding recesses located inside lateral surfaces of a plurality of first clamps and a plurality of second clamps wider than the first clamps at a predetermined depth.

7. The lid frame according to claim 1, wherein each gap compensator of the plurality of gap compensators is installed between the plurality of clamps coupled to the lid frame.

8. The lid frame according to claim 1, wherein the plurality of clamps includes a plurality of first clamps and a plurality of second clamps wider than the first clamps, the first and second clamps being symmetrically disposed on the supports, being separated from each other at predetermined intervals in a lengthwise direction, and being perpendicular to the supports.

9. The lid frame according to claim 8, further comprising press members coupled to press plate holding recesses located inside lateral surfaces of the first and second clamps at a predetermined depth.

10. The lid frame according to claim 1 further comprising press members coupled to press plate holding recesses located inside lateral surfaces of the first and second clamps at a predetermined depth.

11. The lid frame according to claim 10, wherein each of the press members includes:

a press plate facing an inside upper surface of a corresponding clamp and extending in a lengthwise direction of the clamp; and adjustment screw coupling the corresponding clamp to the press plate.

12. The lid frame according to claim 11, wherein the press plate holding recesses include:

a first press plate holding recess located inside each of the first and second clamps and configured to hold the press plate; and a second press plate holding recess located inside each of the second plurality of clamps and configured to hold the press plate.

13. A shipping container for nuclear fuel assembly, the shipping container comprising:

a lower container including a cradle;

an upper container detachably coupled to the lower container;

a base frame coupled to the cradle; and a pair of lid frames installed on opposite long sides of the base frame, wherein each of the lid frames includes, a plurality of clamps separated from each other, and rotatably hinged to the base frame;

a plurality of supports installed apart from each other and coupled perpendicularly to the plurality of clamps; and a plurality of gap compensators coupled to inner surfaces of the supports and configured to compensate for a gap around the inner surfaces of the supports.

* * * * *